US008181659B2

(12) United States Patent
Shin et al.

(10) Patent No.: US 8,181,659 B2
(45) Date of Patent: May 22, 2012

(54) WASHING MACHINE HAVING UV GENERATOR

(75) Inventors: Dong Hoon Shin, Changwon-si (KR); Mi Son Ahn, Seoul (KR); Ji Ho Kim, Busan (KR); Chang Woo Song, Seoul (KR); Kyung Ah Cho, Seoul (KR)

(73) Assignee: LG Electronics Inc., Seoul (KR)

( * ) Notice: Subject to any disclaimer, the term of this patent is extended or adjusted under 35 U.S.C. 154(b) by 727 days.

(21) Appl. No.: 12/089,632

(22) PCT Filed: Oct. 10, 2006

(86) PCT No.: PCT/KR2006/004076

§ 371 (c)(1),
(2), (4) Date: Dec. 18, 2008

(87) PCT Pub. No.: WO2007/043795

PCT Pub. Date: Apr. 19, 2007

(65) Prior Publication Data

US 2009/0301530 A1 Dec. 10, 2009

(30) Foreign Application Priority Data

Oct. 13, 2005 (KR) ..... 10-2005-0096507
Dec. 14, 2005 (KR) ..... 10-2005-0122842
Sep. 6, 2006 (KR) ..... 10-2006-0085506
Sep. 6, 2006 (KR) ..... 10-2006-0085507

(51) Int. Cl.
*B08B 3/00* (2006.01)

(52) U.S. Cl. ..... 134/109; 134/56 D; 134/57 D; 134/58 D

(58) Field of Classification Search ..... 134/56 D, 134/57 D, 58 D, 110, 111, 109
See application file for complete search history.

(56) References Cited

U.S. PATENT DOCUMENTS

| | | | | |
|---|---|---|---|---|
| 3,504,683 | A | 4/1970 | Timmer et al. | 134/172 |
| 3,915,180 | A * | 10/1975 | Jacobs | 134/58 D |
| 6,432,216 | B1 * | 8/2002 | Thies | 134/18 |
| 6,578,586 | B2 * | 6/2003 | Moh | 134/25.2 |
| 6,766,097 | B2 * | 7/2004 | Horton, III | 385/147 |
| 2005/0150528 | A1 * | 7/2005 | Kim | 134/108 |
| 2005/0252532 | A1 * | 11/2005 | Gray et al. | 134/25.2 |
| 2007/0034239 | A1 * | 2/2007 | Park et al. | 134/56 D |

FOREIGN PATENT DOCUMENTS

| | | |
|---|---|---|
| CN | 1636498 | 7/2005 |
| DE | 20014633 U1 * | 11/2000 |
| EP | 1550396 | 7/2005 |

(Continued)

OTHER PUBLICATIONS

KR 2006-025235 Foreign Patent Mar. 2006 Korea Kim.*

(Continued)

*Primary Examiner* — Michael Barr
*Assistant Examiner* — Charles W Kling
(74) *Attorney, Agent, or Firm* — KED & Associates LLP

(57) ABSTRACT

A dishwasher having a UV generator that sterilizes dishes is provided. The dishwasher includes a tub that holds dishes to be washed, a sump that holds washing water, a spray nozzle that sprays the washing water into the dishwasher, and at least one UV generator that directs a UV beam into the dishwasher.

15 Claims, 7 Drawing Sheets

FOREIGN PATENT DOCUMENTS

| | | | | |
|---|---|---|---|---|
| GB | 2192126 | | | 1/1988 |
| JP | 04224726 | A | * | 8/1992 |
| KR | 2006025235 | A | * | 3/2006 |
| KR | 2007081020 | A | * | 8/2007 |
| KR | 2007082389 | A | * | 8/2007 |

OTHER PUBLICATIONS

KR 2006-025235 Machine Translation Mar. 2006 Korea Kim.*
Chinese Office Action dated Jan. 29, 2010.
International Search Report dated Jan. 30, 2007.

* cited by examiner

[Fig. 1]
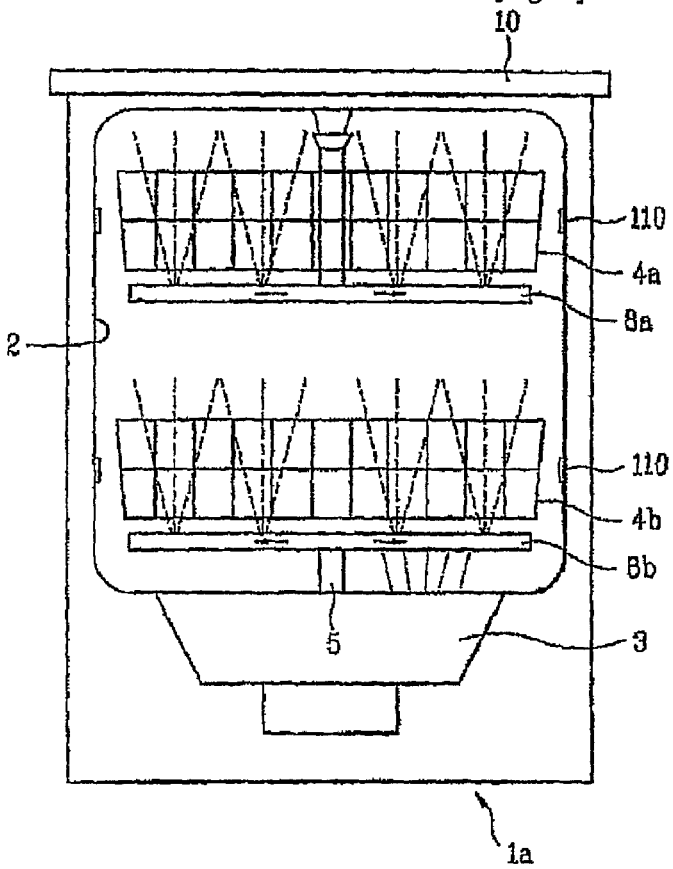
[Fig. 2]
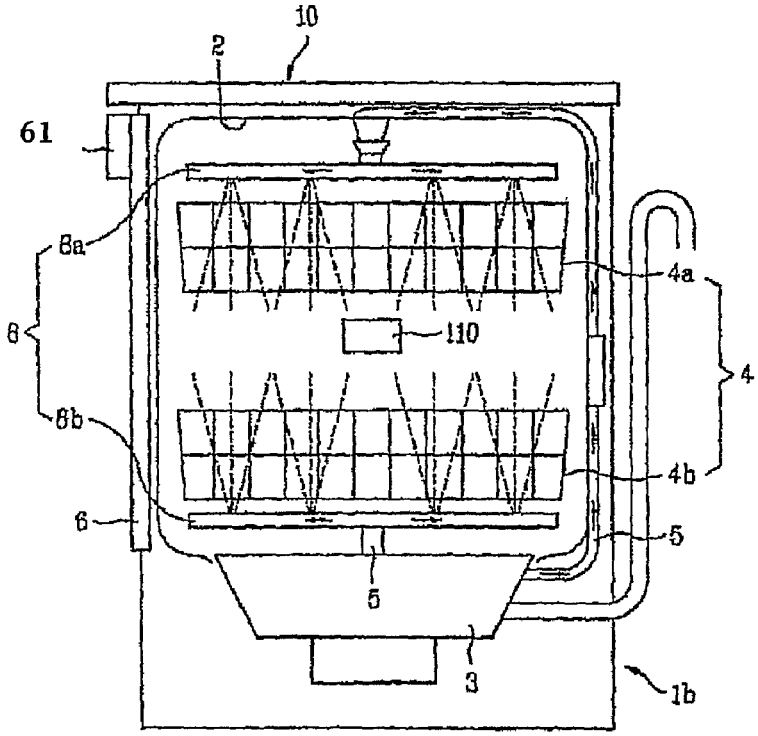

[Fig. 3]
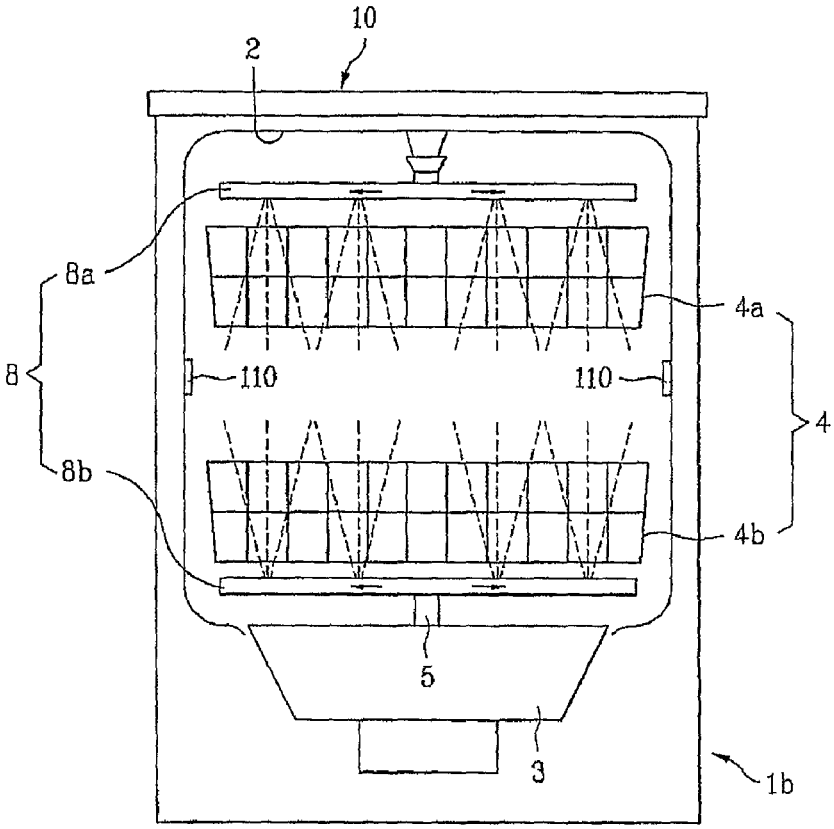
[Fig. 4]
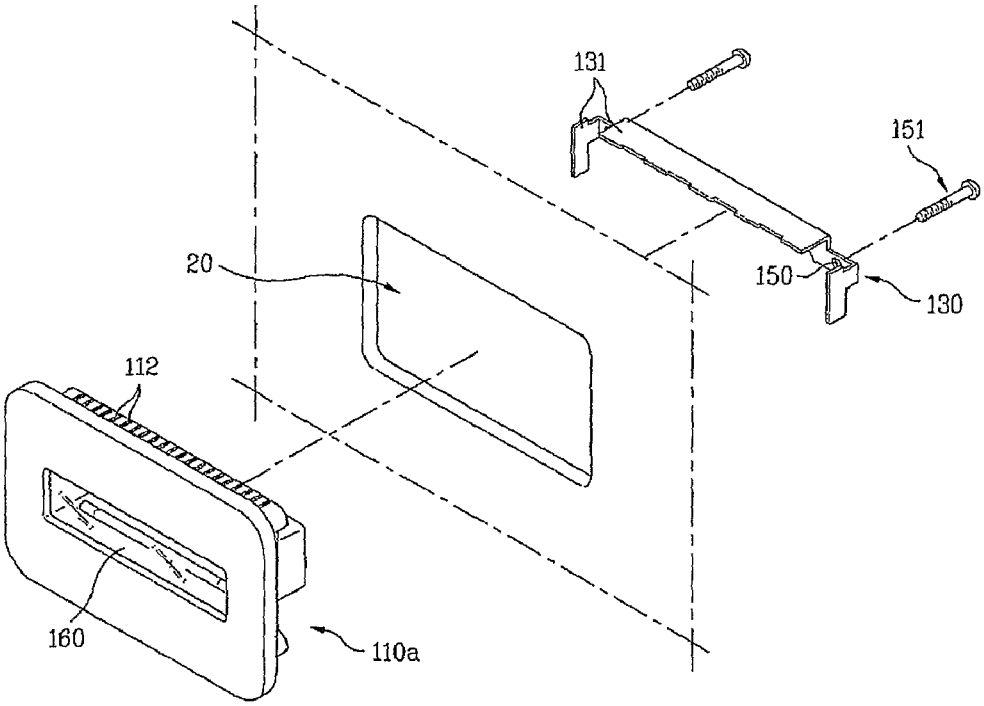

[Fig. 5]
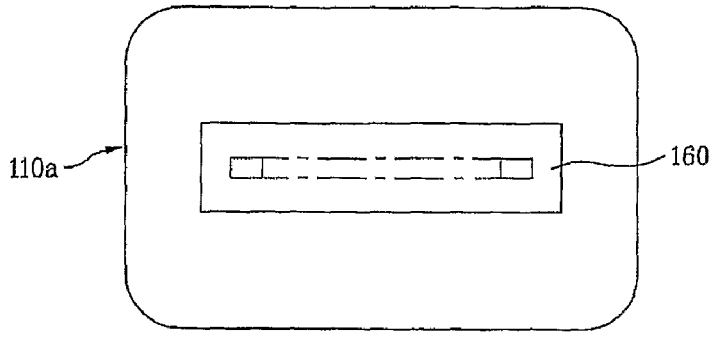
[Fig. 6]
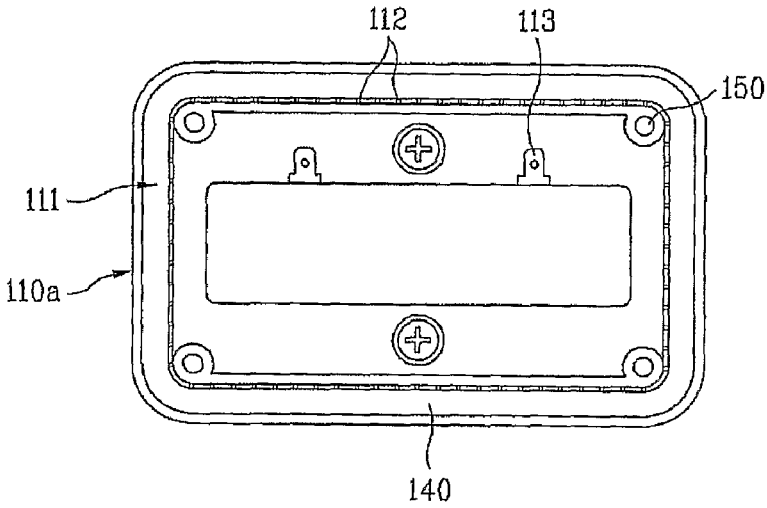
[Fig. 7]
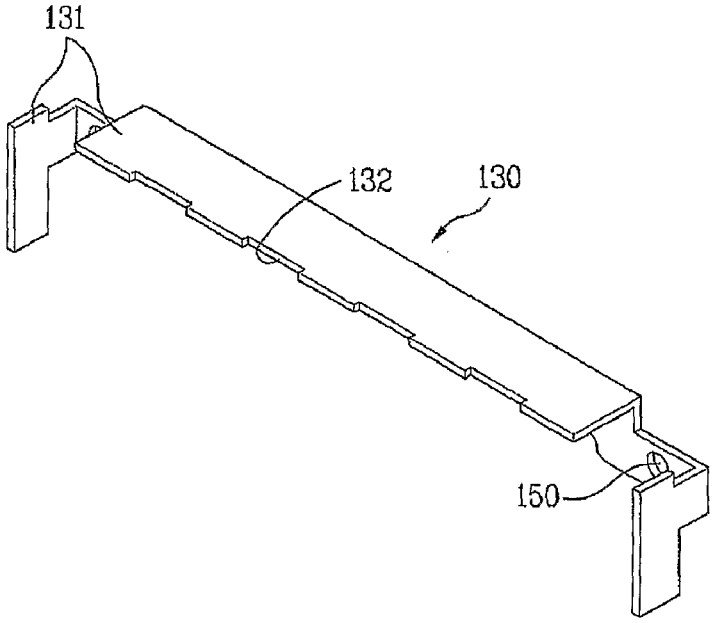

[Fig. 8]
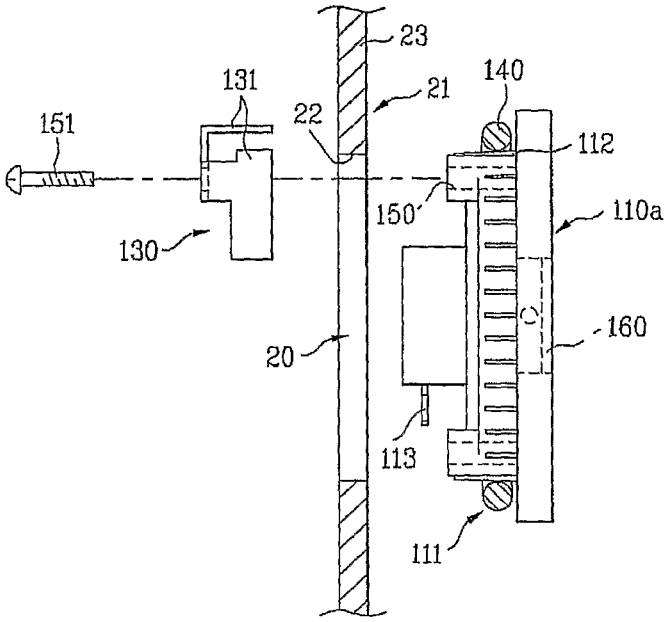
[Fig. 9]
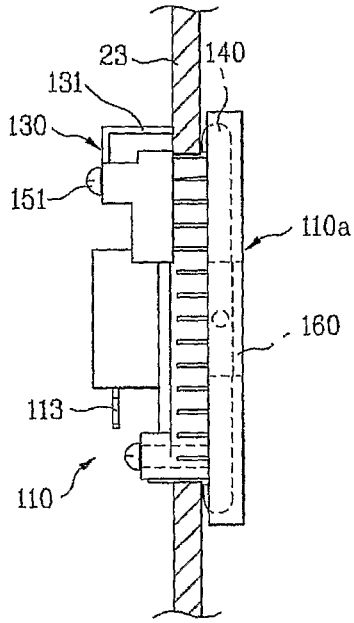
[Fig. 10]
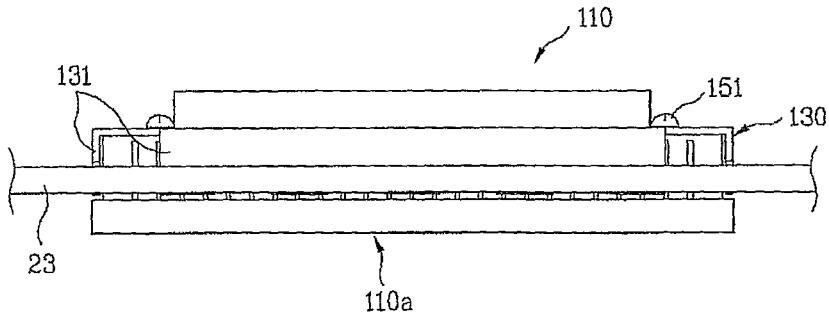

[Fig. 11]
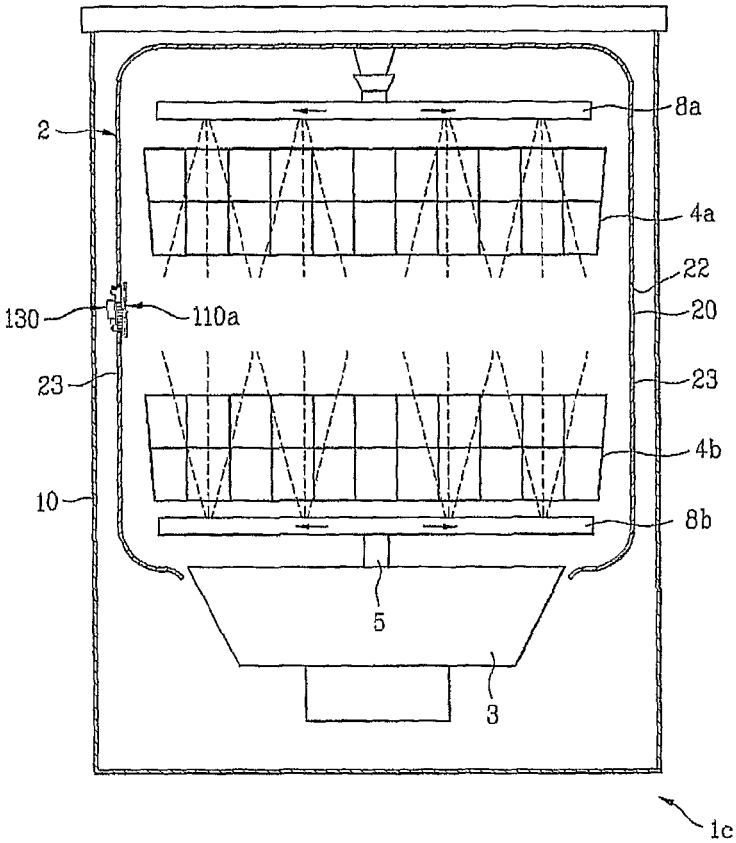
[Fig. 12]
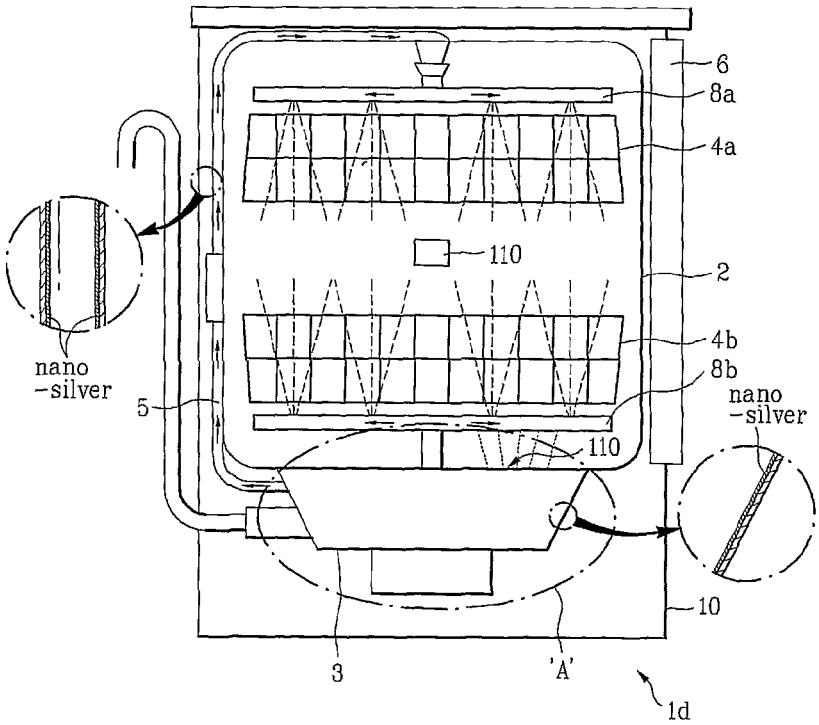

[Fig. 13]
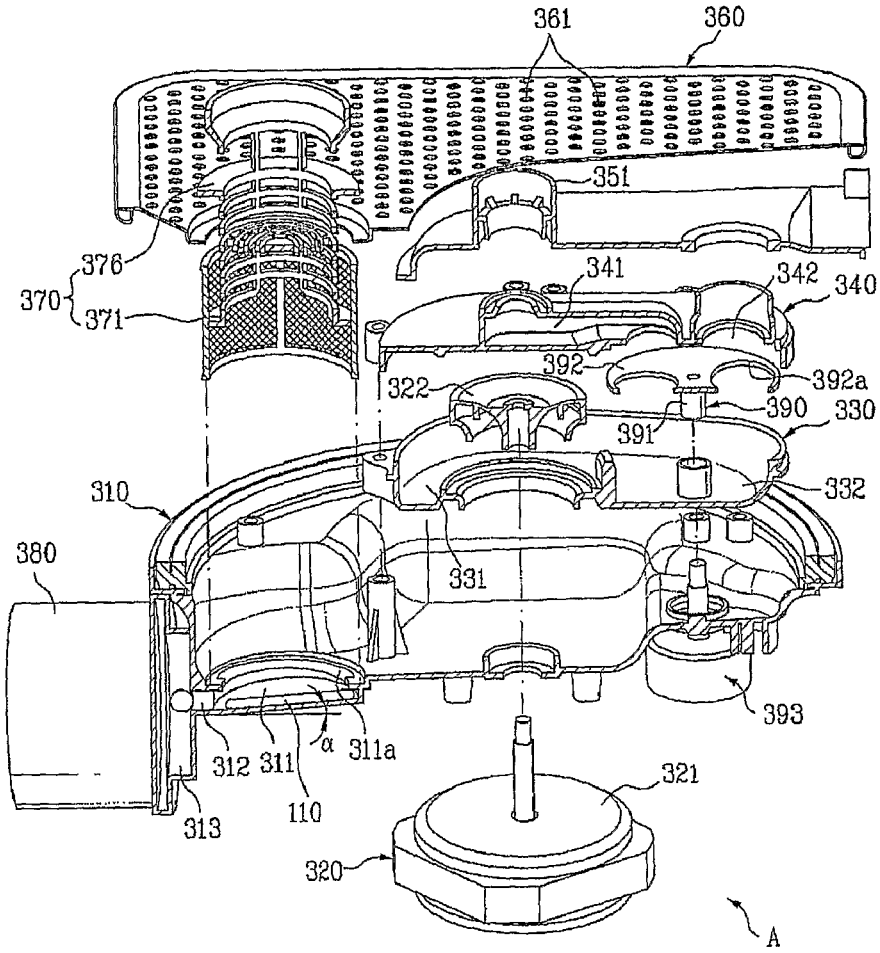
[Fig. 14]
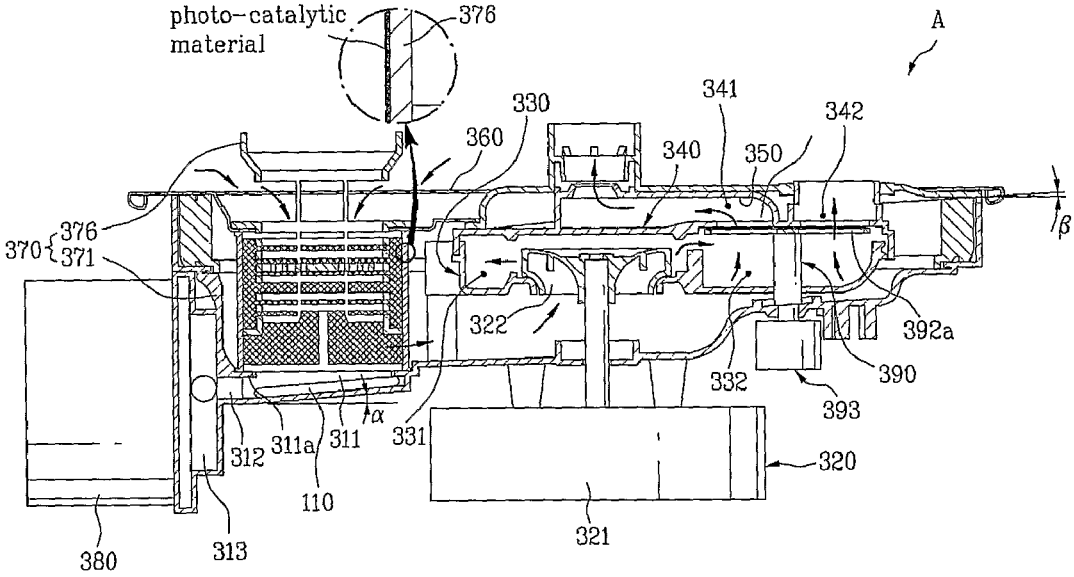

[Fig. 15]
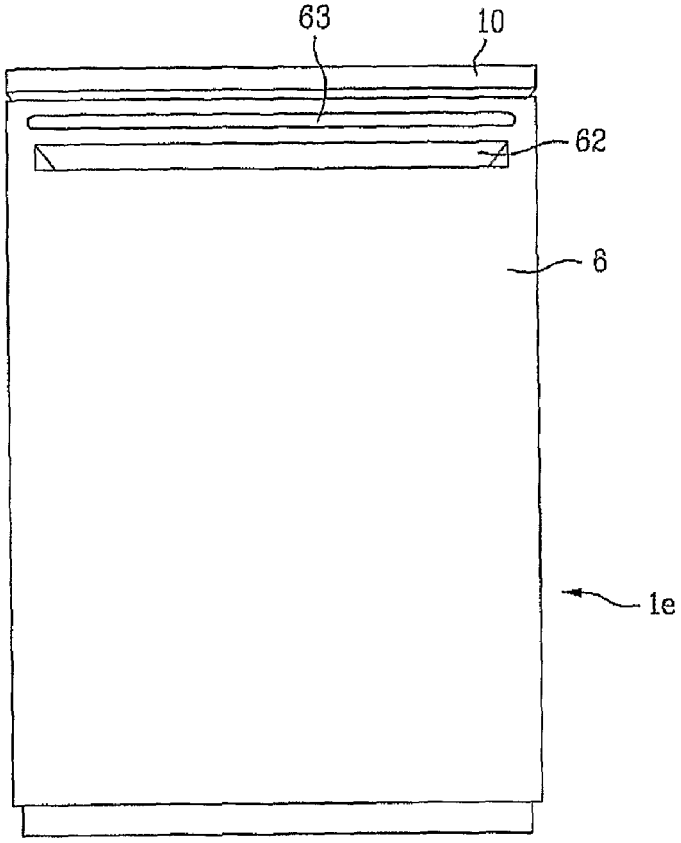
[Fig. 16]
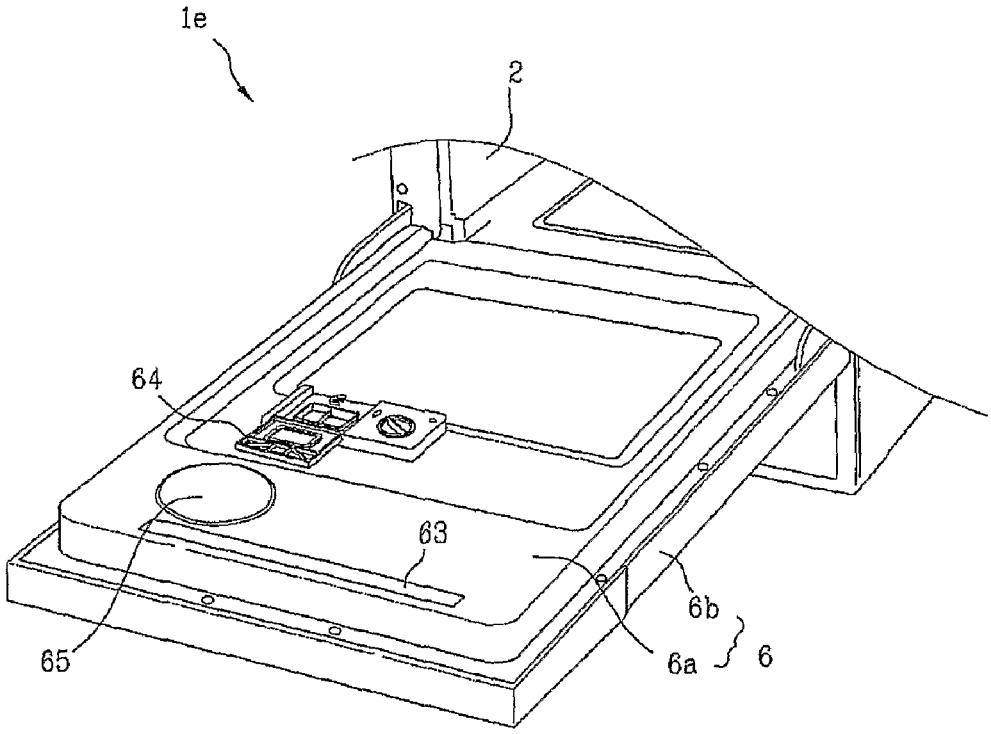

WASHING MACHINE HAVING UV GENERATOR

TECHNICAL FIELD

The present invention relates to dishwashing machines (dish washers), and more particularly, to a dish washer having a UV generator for sterilizing dishes and an inside of dish washer.

BACKGROUND ART

In general, the dish washer sprays washing water mixed with detergent to dishes dirt with food or contaminant for washing the dishes, and dries the dishes.

The dish washer saves labor compared to manual dish washing and is useful for the old, the weak, or the handicapped who has difficulty in movement. Especially, it is a trend that demand of busy modern men on the dish washer increases since they can do other things while the dish washer washes dishes.

A related art dish washer is provided with a body, a tub, a driving unit, a spray nozzle, a washing pump, a drain pump, and so on.

The body forms an exterior of the dish washer and protects components of the dish washer. The dish washer has a door at one side for introducing dishes into the tub.

The tub is formed in the body, and has a space for washing the dishes, actually. Provided to an inside of the tub, there is a rack, in general, with two stages of an upper, and lower stages.

The driving unit is mounted on an underside of the tub for driving the dish washer. The driving unit is provided with a sump for holding washing water, a heater at the sump for heating the washing water, a drain pump at the sump for draining the washing water, and a filter unit for filtering contaminant from the dishes.

The spray nozzle sprays the washing water in the sump to the dishes on the rack for washing the dishes. The spray nozzle is connected to a flow passage extended from the sump and mounted opposite to a bottom of each of the racks.

The washing pump is mounted on an underside of the driving unit for supplying the washing water from the sump to the spray nozzles through flow passages.

The drain pump is connected to the filter mounted to the driving unit for discharging contaminant from the dishes to an outside of the dish washer.

The operation of the related art dish washer will be described.

The washing water is supplied to the sump and therefrom to the spray nozzles by the washing pump through the flow passages. As the washing water is sprayed to the dishes through the spray nozzles, contaminant is removed from the dishes.

In this process, the contaminant from the dishes is gathered to the filter at the driving unit. Then, as the drain pump is put into operation, the contaminant is discharged from the filter unit to an outside of the dish washer.

DISCLOSURE OF INVENTION

Technical Problem

Since the related art dish washer has no sterilizing function, it is required to place the dishes passed through washing and drying in a sterilizing apparatus again for passing through a sterilizing process. Moreover, harmful microbes contained in moisture remained in the tub proliferate at the dishes and an inside of the dish washer, to cause bad hygienic problems.

Technical Solution

To achieve these objects and other advantages and in accordance with the purpose of the invention, as embodied and broadly described herein, a dish washer includes a tub for holding dishes to be washed, a sump for holding washing water, a spray nozzle for spraying the washing water into the dish washer, and at least one UV generator for directing a UV beam into the dish washer.

Preferably, the UV generator includes a UV lamp or a UV LED. Since the UV LED emits a UV beam of a particular wavelength, and the UV lamp emits a wave of a UV wavelength range, the UV lamp or the UV LED can be selected depending on a place to be mounted, and usage.

Preferably, at least one of the UV generators is mounted to a top, a bottom, a side, or a rear of the tub. In a case the UV generator is mounted to one side of the tub, microbes in on the dishes and the tub can be sterilized more effectively because the UV beam from the UV generator is directed to the dishes and the inside of the tub.

More preferably, the dish washer further includes a rack for holding the dishes, and preferably at least one of the UV generators is mounted at a position the same with a height of the rack. In a case the UV generator and the rack are provided at the same height, a sterilization effect is improved because the UV beam is directed to the dishes on the rack from the UV generator, directly.

Preferably, the dish washer further includes a door on a front of the tub for opening/closing the tub, the door having electric outfits mounted therein, the tub has a flow passage mounted on a rear side for providing the washing water to the spray nozzle, and the UV generator is provided to a side of the tub, directly. In this case the UV generator can be mounted without interference with other structures of the dish washer.

In a case the dish washer further includes a door on a front of the tub for opening/closing the tub, at least one UV generator can be mounted to the door for directing the UV beam into the tub. In the case the UV generator is mounted to the door, the microbes on the dishes and the inside of the tub can be sterilized more effectively because the UV beam can be directed to the dishes and the inside of the tub directly from the UV generator.

The dish washer may further include a rack for placing the dishes thereon. The rack may includes an upper rack at an upper portion of the tub for placing the dishes thereon, and a lower rack under the upper rack for placing the dishes thereon. In this case it is preferable that the UV generator is positioned between the upper rack and the lower rack. In a case the UV generator is positioned at the tub or the door between the upper rack and the lower rack, the UV beam can be directed both to the upper rack and the lower rack only with one UV generator.

It is preferable that the spray nozzle includes an upper spray nozzle over the upper rack for spraying the washing water to the upper rack and a lower spray nozzle under the upper spray nozzle for spraying the washing water to the lower rack. In this case a washing capability can be enhanced because the washing water can be sprayed onto the dishes on the racks from the spray nozzles directly.

Preferably, the spray nozzle includes an upper spray nozzle for spraying the washing water into an inside of the tub from an upper portion of the tub, and a lower spray nozzle at a lower portion of the tub or under the upper spray nozzle for spraying the washing water from a lower portion of the tub into the inside of the tub, wherein the UV generator is provided in the middle of a space between the upper spray nozzle and the lower spray nozzle. In this case the UV beam can be directed to the inside of the tub uniformly only with one UV generator.

It is preferable that the upper spray nozzle sprays the washing water downward into the inside of the tub, and the lower spray nozzle sprays the washing water upward into the inside of the tub. In this case it is preferable that the UV generator mounted to the door or the tub at a position between the upper spray nozzle and the lower spray nozzle or the upper rack and the lower rack, and more preferably the UV generator is mounted to the tub at a position in the middle of the space between the upper spray nozzle and the lower spray nozzle. In this case the UV generator can enhance a sterilizing capability because the UV beam can be directed to the inside of the tub uniformly without interference with structures or components in the tub, and, as the UV generator is washed by the washing water sprayed from the upper spray nozzle and/or the lower spray nozzle automatically, the sterilizing capability is enhanced because a clean state of the UV generator is maintained not to interfere the emission of the UV beam by the contaminant.

Preferably, the UV generator mounted to the tub or the door includes a UV generator housing mounted in a pass through hole in one side of the tub for holding the UV lamp or the UV LED, the UV generator having a seating portion for seating a circumferential surface of the pass through hole, and a bracket having a compression portion for pressing the circumferential surface of the pass through hole onto the seating portion if the bracket is fastened to the UV generator housing. In this case the UV generator is fastened to one side of the tub with a strong fastening force without many fastening members, and mounting and replacement of the UV generator becomes easy.

Preferably, the UV generator further includes a sealing member for sealing between the seating portion and the circumferential surface of the pass through hole. In this case, since the pass through hole is sealed at the time the bracket and the UV generator housing are fastened together, washing water leakage from the tub through the pass through hole having the UV generator mounted thereto is prevented.

Preferably, the UV lamp housing has at least one rib on an outside surface so as to be in contact with an edge of the circumferential surface of the pass through hole so that the UV lamp housing is press fit in the pass through hole. In a case the UV generator housing is press fit in the pass through hole, since the pass through hole holds the UV generator housing while tolerances of the edge of the circumferential surface of the pass through hole and the outside surface of the UV generator housing compensates for each other, a fastening force greater than a certain level can be maintained even if the fastening force between the bracket and the UV generator housing is reduced.

Preferably, the rib has a height which becomes the lower from the seating portion in a direction the UV generator housing is fastened. Since the rib has a height which becomes the lower from the seating portion in a direction the UV generator housing is fastened the rib enables the UV generator housing received in the pass through hole, easily.

Preferably, the rib is formed of a material having hardness lower than hardness of the tub. As the rib is formed of a material having hardness lower than hardness of the tub, such that the UV generator housing is received in the pass through hole while the rib is cut in a case the there is no tolerance between the UV generator housing and the pass through hole, more effective compensation of the tolerance can be made, and a strong fastening force can be provided.

Preferably, the compression portion of the bracket has at least one recess in a surface of the compression portion to be in contact with the circumferential surface of the pass through hole. Since the compression portion of the bracket has at least one recess in a surface of the compression portion to be in contact with the circumferential surface of the pass through hole, to concentrate the fastening force between the bracket and the UV lamp housing on a place where no recess is formed, more stronger fastening force can be obtained than a case when no recess is formed, and a tolerance liable to taken place between the circumferential surface and the compression portion of the bracket can be compensated by the recess.

Preferably, the dish washer further includes a filter for filtering the washing water, and the least one UV generator is arranged to direct the UV beam to the tub and the filter at the same time. In this case, since the UV generator is arranged to direct the UV beam to the filter, to sterilize microbes at the filer and around the filter and remove bad odor, a clean and hygienic state can be maintained.

Preferably, in the dish washer further including a filter, the least one UV generator is arranged close to the filter. In this case, since the UV generator can direct a larger quantity of UV beam to the filter, the sterilizing effect is enhanced.

Preferably, the UV generator is positioned below the filter, more preferably tilted. In a case the UV generator is placed under the filter, the UV beam can be directed to the contaminant more effectively, and in a case the UV generator is tilted, the contaminant collected at a bottom of the filter can be discharged, more easily.

Preferably, the filter is coated with photo-catalytic material. In a case the filter is coated with photo-catalytic material, a high sterilizing effect can be obtained owing to the sterilizing effect of the UV beam from the UV generator and the sterilizing effect of the chemical reaction of the photo-catalytic material.

Preferably, the dish washer further includes a fan for discharging air to an outside of the dish washer during operation or after finish of operation of the UV generator. In a case the fan is provided, odor form the ozone generated during operation of the UV generator and contaminant filtered at the filter is discharged to an outside of the dish washer, damage by the ozone and contamination of the dishes with the odor of the contaminant can be prevented.

It is preferable that the sump is coated with nano-silver material. In a case the sump is coated with nano-silver material, breeding of microbes on an inside surface of the sump due to residual water is prevented.

The dish washer includes a flow passage for guiding the washing water, and the flow passage is coated with nano-silver. In a case the flow passage is coated with nano-silver, breeding of microbes due to residual water is prevented.

The dish washer further includes a door on a front of the tub for opening/closing the tub, with a window for determining an inside state of the tub. In a case the door has a window for determining an inside state of the tub, the user can determine whether the UV generator is in operation or not with naked eyes.

Preferably, the door includes a door cover forming an exterior of the door, and a door liner mounted on an inner side of the door cover, the door liner and the door cover are formed to have fastening holes for fastening the window thereto so that the window is fastened together with the fastening holes in the door liner and the door cover. In this case, a state is prevented in which the window is wet with dew such that the user can not determine an inside state of the dish washer because the window is washed with the washing water sprayed from the spray nozzle. Eventually, the user can determine the inside of the tub more easily from an outside of the dish washer.

In another aspect of the present invention, a dish washer includes a tub for holding dishes to be washed, a sump for holding washing water, a filter for filtering the washing water, a fan for discharging air to an outside of the dish washer, and at least one UV generator for directing a UV beam into the tub and the filter. In this case, since the UV generator can direct a UV beam to all regions at which microbes are liable to breed in the dish washer, such as the dishes, the tub, a driver unit of the dish washer including the filter, a positive sterilizing effect can be obtained.

It is preferable that the dish washer further includes a heater for heating the washing water. In this case, since a sterilizing effect of the UV beam, and a sterilizing effect of hot water are obtainable, to permit to obtain a sterilizing effect of the hot water even at a place where it is difficult to obtain the sterilizing effect of the UV beam due to an inside structure of the dish washer to which the UV beam can not be directed a perfect sterilizing effect can be obtained better than only with the UV generator.

Advantageous Effects

A dish washer according to the present invention has an advantageous effect that the dishes and the inside of the dish washer can be sterilized without using a separate sterilizer, because the present invention is provided with at least one UV generator in the dish washer for directing a UV beam.

BRIEF DESCRIPTION OF THE DRAWINGS

FIG. 1 illustrates a longitudinal section of a dish washer in accordance with a first preferred embodiment of the present invention, schematically.

FIG. 2 illustrates a longitudinal section of a dish washer in accordance with a second preferred embodiment of the present invention, schematically.

FIG. 3 illustrates a section of a dish washer in accordance with a second preferred embodiment of the present invention, schematically;

FIG. 4 illustrates a perspective view of a UV generator in accordance with a third preferred embodiment of the present invention.

FIG. 5 illustrates a front view of a UV lamp housing of a UV generator in accordance with a third preferred embodiment of the present invention.

FIG. 6 illustrates a back view of a UV lamp housing of a UV generator in accordance with a third preferred embodiment of the present invention.

FIG. 7 illustrates a perspective view of a bracket of a UV generator in accordance with a third preferred embodiment of the present invention.

FIG. 8 illustrates a side view of a mounting structure of a UV generator in accordance with a third preferred embodiment of the present invention.

FIGS. 9 and 10 illustrate side views each showing a mounted state of a UV generator in accordance with a third preferred embodiment of the present invention.

FIG. 11 illustrates a section of a dish washer having a UV generator provided thereto in accordance with a preferred embodiment of the present invention.

FIG. 12 illustrates a section of a dish washer in accordance with a fourth preferred embodiment of the present invention, schematically.

FIG. 13 illustrates an exploded perspective view of a driver mounting unit provided to a dish washer in accordance with a fourth preferred embodiment of the present invention.

FIG. 14 illustrates a section of a driver mounting unit provided to a dish washer in accordance with a fourth preferred embodiment of the present invention.

FIG. 15 illustrates a front view of a dish washer in accordance with a fifth preferred embodiment of the present invention.

FIG. 16 illustrates a partial perspective view of an inside of a door of a dish washer in accordance with a fifth preferred embodiment of the present invention.

DESCRIPTION OF SYMBOLS ON KEY PARTS IN THE DRAWING

1*a*, 1*b*, 1*e*, 1*d*, and 1*e*: dish washer 2: tub
3: sump 4: rack
5: flow passage 6: door
110: UV generator 370: filter

BEST MODE FOR CARRYING OUT THE INVENTION

Reference will now be made in detail to the preferred embodiments of the present invention, examples of which are illustrated in the accompanying drawings.

FIG. 1 illustrates a longitudinal section of a dish washer in accordance with a first preferred embodiment of the present invention, schematically.

The dish washer 1*a* in accordance with a first preferred embodiment of the present invention includes a cabinet 10 which forms an exterior of the dish washer, a tub 2 protected by the cabinet 10 for holding dishes therein, a door 6 on a front of the tub 2 for opening/closing the tub 2, a sump 3 at a center of a bottom of the tub 2 for holding washing water, and a UV generator 110 at one side of the tub 2.

The dish washer 1*a* also includes a washing pump (not shown) connected to the sump 3 for pumping the washing water from the sump 3 at a high pressure, and a washing motor (not shown) at a rear of the washing pump for driving the washing pump.

The dish washer 1*a* also includes a flow passage 5 which is a passage for moving the washing water pumped by the washing pump, a lower spray nozzle 8*b* at a lower portion of the tub for spraying the washing water upward and an upper spray nozzle 8*a* at an upper portion of an inside of the tub 2 branched from a point of the flow passage 5 for spraying the washing water upward.

In detail, the upper spray nozzle 8*a* is rotatably pined with the flow passage 5.

The dish washer 1*a* also includes an upper rack 4*a* mounted over the upper spray nozzle 8*a*, and a lower rack 4*b* mounted between the upper spray nozzle 8*a* and the lower spray nozzle 8*b*.

The upper rack 4*a* is supported on a rail (not shown) at a side of the tub 2, and movable in front/rear directions. The upper spray nozzle 8*a* is fixedly secured to a bottom of the upper rack 4*a*, to move in front/rear directions together with the upper rack 4*a*.

The UV generator 110 is mounted to one of an upper, lower, side, and rear of the tub 2. The UV generator 110 emits a UV ray into the tub 2 for sterilization. As the UV generator, a UV LED which emits a UV ray having a particular range of wavelength, or a UV lamp which emits a wave of UV ray range may be used. In the dish washer of the embodiment, the UV lamp is used as the UV generator.

Though the UV generator 110 can be mounted to a ceiling, side, or rear of the tub 2, the dish washer in the first embodiment of the present invention has the UV generator 110 mounted to a side of the tub 2 at the same positions of heights of the upper rack 4*a* and the lower rack 4*b*.

The operation of the dish washer 1*a* in accordance with a first preferred embodiment of the present invention will be described.

The user opens the door 6 on the dish washer 1*a*, and pulls the upper rack 4*a* and/or the lower rack 4*b* outward. Then, the user places the dishes on the rack 4. Then, the user closes the door 6, and applies power to operate the dish washer 1*a*.

In the meantime, if the power is applied to the dish washer 1*a* to perform a washing step, the washing water is introduced into the sump 3, and when the washing water introduction step ends, the motor is started. As the impeller (not shown) in the washing pump connected to the motor with a shaft rotates, the washing water is pumped to the lower spray nozzle 8*a* or the flow passage 5, alternately.

The washing water pumped to the flow passage 5 is moved to the upper spray nozzle 8*a* finally, and sprayed into the tub 2. Then, a process is taken in which the dishes on the rack are washed by the sprayed washing water.

In this instance, by spraying the washing water upward from under the rack 4, the upper spray nozzle 8*a* and/or the lower spray nozzle 8*b* washes the dishes on the rack 4.

Foreign matters in contaminated washing water collected in the sump 3 in the washing process is filtered of by the filter (not shown). The washing water having the foreign matters filtered therefrom is discharged to an outside of the dish washer 1*a* through the drain pump (not shown) if a drain step is started after finish of the washing step.

If the washing water is discharged to an outside of the dish washer, the washing water is introduced into the sump 3 again through an inlet, and sprayed through the spray nozzle 8 the same with the washing step. By the sprayed washing water, the dishes pass through a rinsing step.

By passing through a drying step upon finish of the rinsing step, the washing is finished.

Upon finish of the drying step, the UV generator 110 is turned on, to perform a sterilizing step. Upon finish of the sterilizing step, the UV generator 110 is turned off. However, the sterilizing step may be performed, not only in the case when the drying step is finished but also in parallel with the washing step and, or the rinsing step.

Because the UV generator 110 is provided to the side of the tub 2 at positions the same with heights of the upper rack 4*a* and the lower rack 4*b*, it is possible that the dishes can be sterilized by respective UV generators 110. In a case the dishes are placed only on one of the upper rack 4*a* or the lower rack 4*b*, the UV generator positioned close to the rack 4 having the dishes placed thereon may be operated, to enhance a sterilizing effect, as well as reduce power consumption.

MODE FOR THE INVENTION

FIGS. 2 and 3 illustrate longitudinal sections each showing a structure of a dish washer in accordance with a second preferred embodiment of the present invention, schematically.

The dish washer 1*b* in accordance with a second preferred embodiment of the present invention includes a tub 2, a door 6, a spray nozzle 8, a UV generator 110.

The tub 2 is mounted in a body 10 of the dish washer, holds the dishes which are washing objects and forms a washing chamber for washing the dishes together with the door 6. The tub 2 has an opened front closed with the door 6. Mounted to an upper portion of the tub 2, there is an upper spray nozzle 8*a*. Mounted to a lower portion of the tub 2, there is a lower spray nozzle 8*b*, and mounted to the lower portion of the tub 2, there is a sump 3 for holding the washing water and supplying the washing water to the upper spray nozzle 8*a* and the lower spray nozzle 8*b*. Mounted on a rear wall of the tub 2, there is a flow passage 5 for supplying the washing water from the sump 3 to the upper spray nozzle 8*a* and the lower spray nozzle 8*b*.

There is a rack 4 in the tub 2, having an upper rack 4*a* and a lower rack 4*b*.

The door 6 is positioned on a front of the tub 2 to open/close an opening of the tub 2. The door 6 forms a washing chamber together with the tub 2. Mounted on a front of the door 6, there is control panel 61 for controlling operation of the dish washer.

The spray nozzle 8 sprays washing water to the dish washer. The spray nozzle 8 includes an upper spray nozzle 8*a* for spraying the washing water downward in the tub 2, and a lower spray nozzle 8*b* for spraying the washing water upward in the tub 2. The spray nozzles are mounted to the upper portion and the lower portion of the tub 2 for spraying the washing water to the dishes placed on the upper rack 4*a* and the lower rack 4*b*.

The UV generator 110 emits a UV beam into the tub 2 for sterilizing microbes. As the UV generator, a UV LED which emits a UV ray having a particular range of wavelength, or a UV lamp which emits a wave of UV ray range may be used. In the dish washer of the embodiment, the UV LED is used as the UV generator.

The UV generator 110 is provided to a side of the tub 2 for uniform emission of the UV wave into the tub 2. Particularly, the UV generator 110 is provided in the middle of a space between the upper spray nozzle 8*a* and the lower spray nozzle 8*b*.

The operation of the dish washer in accordance with a second preferred embodiment of the present invention will be described.

Upon putting the dish washer in accordance with the second preferred embodiment of the present invention into operation, the washing water is pumped from the sump 3 to the upper spray nozzle 8*a* and/or the lower spray nozzle 8*b* by the washing pump. Accordingly, the washing water is sprayed to the dishes placed on the upper rack 4*a* and/or the lower rack 4*b* from the upper spray nozzle 8*a* and the lower spray nozzle 8*b* respectively, to wash the dishes. The washing water can be supplied to the upper spray nozzle 4*a* or the lower spray nozzle 4*b* singly or at the same time depending on a method for controlling the dish washer.

Referring to FIG. 2, since the UV generator 110 is mounted in the middle of the space of the side of the tub 2 between the upper spray nozzle 8*a* and the lower spray nozzle 8*b*, the strong washing water from the upper spray nozzle 8*a* and the lower spray nozzle 8*b* is sprayed onto the UV generator 110, to wash the UV generator 110, automatically. Moreover, even if the washing water is supplied singly either from the upper spray nozzle 8*a* or the lower spray nozzle 8*b* depending on the method for controlling the dish washer 1*b*, the UV generator 110 is washed by the washing water sprayed singly either from the upper spray nozzle 8*a* or the lower spray nozzle 8*b* automatically owing to a mounting position of the UV generator 110. Accordingly, since a clean state of the UV generator 110 is maintained by the washing water automatically, such that the contaminant does not impede the emission of the UV beam, a sterilization capability is enhanced.

The washing water sprayed onto the dishes returns to the sump 3 through a hole (not shown) in communication with the sump 3. In this instance, the washing water containing the contaminant from the dishes may be filtered through a filtering unit (not shown).

After the washing is finished and the washing water is drained a drying step is performed for drying the dishes. In the drying step, the heater is put into operation, to heat and vaporize the moisture remained on the dishes, and the vapor generated thus is introduced into an inlet of an exhaust duct (not shown), and discharged through an outlet.

During the washing step, the UV generator 110 may be operated to put a sterilizing function into action in parallel with the washing.

In a case the UV generator is mounted to the door 6, the UV generator interferes with electric components (for an example, a control panel, fan, wiring, and so on) on the door 6, and is liable to suffer from damage in a course the dishes are put in/taken out of the tub 2.

In a case the UV generator 110 is mounted on a top side or a bottom side of the tub 2, the uniform spreading of the UV beam into the tub 2 is impeded by the upper spray nozzle 8*a*, the lower spray nozzle 8*b*, the upper rack 4*a* and the lower rack 4*b*, to provide a poor sterilizing capability. Moreover, in this case, replacement of the UV unit 110 due to out of order and the like is not easy because of the position, to require dismounting of other components too.

In a case it is intended to mount the UV generator to the rear of the tub 2, it is required to change the flow passage 5 that supplies the washing water to the upper spray nozzle 8*a* from the sump 3, which is difficult to do.

However, because the dish washer 1*b* in accordance with the embodiment of the present invention has the UV generator 110 provided in the middle of the space of the side of the tub 2 between the upper spray nozzle 8*a* and the lower spray nozzle 8*b* where no particular structure or element is, the UV generator 110 can be mounted without interference with other element or structure of the dish washer, and can make uniform emission of the UV beam into the tub 2, to enhance the sterilization capability of the dish washer.

FIGS. 4 to 10 illustrate UV generators each provided to the dish washer in accordance with a third preferred embodiment of the present invention and FIG. 11 illustrates a section of a dish washer in accordance with a third preferred embodiment of the present invention, schematically.

The dish washer 1*c* in accordance with the third preferred embodiment of the present invention includes a tub 2, a door (not shown), a spray nozzle 8, a pass through hole 20, and a UV generator 110.

The tub 2 is mounted in a body 10 of the dish washer 1*c*, holds the dishes which are washing objects, and forms a washing chamber for washing the dishes together with the door. The tub 2 has an opened front closed with the door. Mounted to an upper portion of the tub 2, there is an upper spray nozzle 8*a*. Mounted to a lower portion of the tub 2, there is a lower spray nozzle 8*b*, and mounted to the lower portion of the tub 2, there is a sump 3 for holding the washing water and supplying the washing water to the upper spray nozzle 8*a* and the lower spray nozzle 8*b*. Mounted on a bottom and a rear of the tub 2, there is a flow passage 5 for supplying the washing water from the sump 3 to the upper spray nozzle 8*a* and the lower spray nozzle 8*b*.

There is a rack 4 in the tub 2, having an upper rack 4*a* and a lower rack 4*b*.

The door is positioned on a front of the tub 2 to open/close an opening of the tub 2. The door forms the washing chamber together with the tub 2. Mounted on a front of the door, there is a control panel (not shown) for controlling operation of the dish washer 1*c*.

The spray nozzle 8 sprays washing water to an inside of the dish washer 1*c*. The spray nozzle 8 includes an upper spray nozzle 8*a* for spraying the washing water downward in the tub 2, and a lower spray nozzle 8*b* for spraying the washing water upward in the tub 2. The spray nozzles 8*a* and 8*b* are mounted to the upper portion and the lower portion of the tub 2, respectively, for spraying the washing water to the dishes placed on the upper rack 4*a* and the lower rack 4*b*.

The pass through hole 20 is provided to one side 23 of the tub 2, for receiving the UV generator 110.

The UV generator 110 includes a UV generator housing 110*a*, and a bracket 130.

The UV generator housing 110*a* has a recess 160 in a front for holding a UV emission element, with a transparent window for protecting the UV emission element. The UV LED emits a UV beam into the tub 2 for sterilizing microbes. The UV generator 110 may include a UV LED which emits a UV beam having a particular range of wavelength, or a UV lamp which emits a wave of a UV beam range as the element for emission of the UV beam. In the dish washer of the embodiment, the UV LED is used as the UV generator.

There is a power supply terminal 113 on a rear of the UV generator housing 110*a* for supplying power to the UV LED. Upon application of power to the power supply terminal 113, the UV emission element emits a UV beam.

The UV lamp housing 110*a*, holding the UV LED at a front thereof that faces the tub 2, is mounted in the pass through hole 20, and has a seating portion 111 for seating on a circumferential surface 21 of the pass through hole 20.

The seating portion 111 is an extension from a surface of the UV generator housing 110*a* which faces an inside of the tub 2 parallel to a surface of the tub 2. The seating portion 111 prevents the UV generator 110 from falling off to an outer side of the tub 2 through the pass through hole 20 and exerts compression force to one side 23 of the tub 2.

Between the seating portion 111 and the circumferential surface 21 of the pass through hole 20, there is a sealing member 140 for sealing a gap between the surface of the tub 2 and the UV generator housing 110*a* for preventing leakage of washing water from the tub 2 through the pass through hole 20 having the UV generator 110 fastened thereto. As shown in FIG. 8, the sealing member 140 provided in the embodiment of the present invention is fastened to the seating portion 111.

On an outside surface of the UV generator housing 110*a*, there is at least one rib 112 for making surface to surface contact with an edge 22 of the circumferential surface of the pass through hole 20, so that the UV generator housing 110*a* is press fit in the pass through hole 20.

The rib 112 is extended in a direction on the seating portion 111 that the UV generator 110 is received to the pass through hole 20. It is preferable that the rib 112 has a height which becomes the lower in a direction the UV generator housing 110*a* is fastened.

Moreover, it is preferable that the rib 112 is formed of a material having a hardness lower than a hardness of a material of the tub 2.

Referring to FIG. 9, though the housing 110*a* in the pass through hole 20 does not reach to the edge 22 of the circumferential surface of the pass through hole 20, the rib 112 has a height reached beyond the edge 22 of the circumferential surface of the pass through hole 20.

The UV generator housing 110*a* has a fastening hole 150 on a rear for fastening the bracket 130 thereto.

The bracket 130 is fastened to the housing 110*a*, and has a compression portion 131 for compressing the circumferential surface 21 of the pass through hole 20.

Referring to FIGS. 7 and 8, the bracket 130 has a fastening hole 150. The bracket 130 is fastened to the fastening hole 150 in a rear surface of the UV lamp housing 110*a* with a fastening member 151 such as a screw.

The bracket 130 has the compression portion 131 extended in a lateral direction of the tub 2. The compression portion 131 transmits fastening force generated when the housing 110*a* and the bracket 130 are fastened together to the circumferential surface 21. As shown in FIGS. 8 and 9, in view of a fastening form of the bracket 130 and the housing 110*a*, the seating portion 111 of the housing 110*a* presses the circumferential surface 21 of the pass through hole 20 in a direction opposite to a direction in which the compression portion 131 transmits the fastening force. Accordingly, the edge 22 of the circumferential surface of the pass through hole 20, i.e., one side 23 of the tub 2 is held between the compression portion 131 and the seating portion 111.

The compression portion 131 of the bracket 130 has at least one recess 132 in a surface where the compression portion 131 is in contact with the circumferential surface 21 of the pass through hole 20. The recess 132 enables the compression portion 131 to provide a fastening force stronger than a case when there is no recess 132 because the fastening force is concentrated to a portion of the compression portion 131 where no recess 132 is formed.

The operation of the dish washer 1*c* in accordance with the third preferred embodiment of the present invention will be described.

Because the UV generator 110 is secured to the tub 2 as the seating portion 111 of the housing 110*a* and the compression portion 131 of the bracket 130 press the circumferential surface 21 of the pass through hole 20 in the tub 2, the UV generator 110 of the dish washer 1*c*, a strong fastening force can be obtained without the fastening member 151, and easy mounting and replacement of the UV generator 110 is permitted.

The sealing member 140 between the seating portion 111 of the dish washer in accordance with the preferred embodiment of the present invention and the circumferential surface 21 of the pass through hole 20, to seal the pass through hole 20 owing to fastening of the bracket 130 to the housing 110*a*, prevents the washing water from leaking from the tub 2 through the pass through hole 20 which holds the UV generator 110.

Because the rib 112 on the dish washer 1*c* in accordance with the preferred embodiment of the present invention has a height which becomes the lower in a direction the housing 110*a* is fastened at the seating portion 111, the rib 112 enables the housing 110*a* received in the pass through hole 20, easily.

Moreover, since the rib 112 has a height provided beyond the edge 22 of the circumferential surface of the pass through hole 20 and is formed of a material having a hardness lower than a hardness of the material of the washing tub, in a case the housing 110*a* is press fit in the pass through hole 20, a portion having no tolerance between the pass through hole 20 and the housing 110*a* is received in the pass through hole while a portion of the rib 112 is cut away, the tolerance is compensated more efficiently, and a strong fastening force is formed as the rib 112 and the edge 22 of the circumferential surface of the pass through hole 20 engage.

Owing to at least one recess 132 in a surface the compression portion 131 is in contact with the circumferential surface 21 of the pass through hole 20, the compression portion 131 of the bracket 130 provided to the dish washer 1*c* in accordance with the third preferred embodiment of the present invention concentrates the fastening force between the bracket 130 and the housing 110*a* on a portion where there is no recess 132.

Moreover, a tolerance liable to form between the circumferential surface 21 and the compression portion 131 of the bracket 130 is compensated by the recess 132.

FIG. 12 illustrates a section of a dish washer in accordance with a fourth preferred embodiment of the present invention schematically, and FIGS. 13 and 14 illustrate drawings each showing a driver mounting unit provided to a dish washer in accordance with a fourth preferred embodiment of the present invention.

The dish washer 1*d* in accordance with a fourth preferred embodiment of the present invention includes a body 10, a tub 2, a spray nozzle 8, a driver mounting portion A at a lower portion of the tub for mounting various electric outfits and the like for supplying high pressure washing water to the tub, a UV generator 110, and a fan (not shown).

The body 10 forms an exterior of the dish washer 1*d*. The tub 2 is a space in the body 10 for holding and washing the dishes.

The tub 2 is provided with a rack 4 having an upper rack 4*a* and a lower rack 4*b* for placing the dishes thereon.

The spray nozzle 8 includes an upper spray nozzle 8*a* at an upper portion of the tub 2 for spraying the washing water downward to an inside of the tub 2 and the upper rack 4*a*, and a lower spray nozzle 8*b* at a lower portion of the tub 2 for spraying the washing water upward to the inside of the tub 2 and the lower rack 4*b*.

The UV generator 110 is mounted in the middle of a space of a side of the tub 2 between the upper spray nozzle 8*a* and the lower spray nozzle 8*b*.

Referring to FIG. 13, the driver mounting portion A includes a sump 3 for holding the washing water, a washing pump 30 for pumping the washing water from the sump 3, a housing assembly 330, 340, and 350 having a flow passage 5 for guiding pumped washing water to the spray nozzle 8, a cover 360 for covering a top of the sump 3, a filter 370 arranged in the sump 310 passed through the cover 360 for filtering the washing water fallen on the cover 360 and introducing the filtered washing water into the sump 3, a drain pump 380 in communication with the filter 370 for draining the washing water from the sump 3 and contaminant filtered at the filter 370 to an outside of the dish washer in a draining course, and a UV generator 110 arranged close to a lower portion of the filter 370 for sterilizing the contaminant failed to be filtered at the filter 370 after finish of operation of the dish washer.

In this instance, it is preferable that there is a heater (not shown) in the sump 3 for heating the washing water.

The sump 3 has a contaminant holding chamber 311 in communication with the drain pump 380 for holding the contaminant filtered at the filter 370. It is preferable that the contaminant holding chamber 311 is mounted on a bottom of the sump 3. It is more preferable that the contaminant holding chamber 311 is sloped down toward the drain pump 380 (a: see FIG. 14), for easy discharge of the contaminant from the contaminant holding chamber 311 by using the drain pump 380.

There is a drain flow passage 312 for making the contaminant holding chamber 311 and the drain pump 380 in communication. In this instance, it is preferable that the contaminant holding chamber 311 and the drain chamber 313 are made to be in communication by the drain flow passage 312.

Moreover, the sump 3 has a drain chamber 313 for mounting the drain pump 380. The drain pump 313 has a space for mounting an impeller 322 therein, and a space for drawing the contaminant.

The washing pump 320 includes a washing motor 321 for generating a driving force, and the impeller 322 coupled to the washing motor 321 with a shaft. In this instance, the washing motor 321 is an upright driving type with a vertical shaft. The drain pump 380 includes a drain motor (not shown) and an impeller (not shown). The drain pump is a horizontal driving type with a horizontal shaft.

In the meantime, the housing assembly includes a pump chamber 331 having the impeller 322 of the washing pump 320 arranged therein, a flow passage control chamber 332 in communication with the pump chamber 331, having a flow control valve 390 arranged therein, and a main flow passage 341, and 342 for guiding the washing water from the flow control chamber 332 to the spray nozzle 8 through the flow passage 5.

It is preferable that the pump chamber 331 and the flow passage control chamber 332 are arranged at the same plane. This is for reducing a height of the housing assembly 330, 340, and 350, and increasing an inside space of the sump 3. It is preferable that the main flow passage 341, and 342 is arranged above the pump chamber 331 and the flow passage control chamber 332. This is for reducing an area of the housing assembly 330, 340, and 350.

An example of the housing assembly will be described.

The housing assembly includes a lower housing 330 having the pump chamber 331 and the flow passage control chamber 332, and an upper housing 340 on a top of the lower housing 330, having the main flow passage 341, and 342. As shown in FIG. 14, the lower housing 330 and the upper housing 340 may be fabricated as individual members or, though not shown, as one body.

In this instance, it is preferable that the housing assembly also includes a connection housing 350 to cover a top side of the upper housing 340 and connected to the flow passage 5 connected to the spray nozzle 8. The connection housing 350 has a connection portion for connection to the flow passage 5.

Moreover, it is preferable that the cover 360 which covers the sump 3 is tilted toward the filter 370 (b: FIG. 14), so that the washing water and the contaminant fallen on the cover 360 flows toward the filter 370, easily.

It is preferable that the cover 360 has a plurality of filter holes 361 for direct introduction of a portion of the washing water fallen on the cover 360 into the tub after being filtered. It is more preferable that the filter holes 361 are arranged only at portions where the housing assembly 330, 340, and 350 is avoided for minimizing an outside surface of the housing assembly with the washing water.

In the meantime, the filter 370 has an opened bottom. The opened bottom of the filter 370 is connected to the contaminant holding chamber 311. it is preferable that the bottom of the filter 370 and a bottom of the contaminant holding chamber 311 is spaced a predetermined distance.

For an example, the opened bottom of the filter 370 is supported on a step formed on a top of the contaminant holding chamber 311. The drain flow passage 312 is arranged on a lower side of the step of the contaminant holding chamber 311. According to this, the contaminant is drain from the contaminant holding chamber 311 to the drain chamber through the drain flow passage 312 without interference of the filter 370.

The filter 370 includes an upper filter 376 passed through the cover 360, for allowing the washing water and the contaminant fallen on the cover 360 to pass, and a lower filter 371 having an opened bottom connected to the contaminant holding chamber 311 for filtering contaminant from the washing water.

It is preferable that the upper filter 376 and the lower filter 371 are detachably mounted on the cover 360. The upper filter 376 filters large sized contaminant, and the lower filter 371 filters small sized contaminant that the upper filter 376 fails to filter.

It is preferable that the filter 370 is coated with a photo-catalytic material, and more preferably, with the lower filter 371 is coated with the photo-catalytic material.

It is preferable that the upper filter 376 is projected beyond a top surface of the cover 360 by a predetermined height for the user to hold and pulling out the upper filter easily. Of course, it is not necessary to arrange the upper filter 376 to be projected beyond the top surface of the cover 360 as far as the user can hold and pull out the upper filter 376 easily.

It is preferable that the UV generator 110 is arranged close to a lower portion of the lower filter 371, and a UV lamp or a UV LED is provided to the UV generator 110.

For convenience sake, in the first embodiment of the present invention, an example of the UV lamp will be described as the UV generator 110.

In the meantime, since a sterilizing effect of the filter 370 can vary according to a position of UV lamp 110 directing the beam, it is the most effective and desirable that the UV lamp 110 is arranged close to the lower portion of the lower filter 371, rather than the upper side of the filter 370, to direct the beam toward the filter 370.

According to this, it is preferable that the UV lamp 110 is arranged on one side of the contaminant holding chamber 311. Since the contaminant holding chamber 311 is sloped toward the drain pump 380, it is preferable that the UV lamp 110 is sloped for easy drainage of the contaminant from the contaminant holding chamber 311 to the drain pump 380.

The filter 370 has a grating structure, and if intensity of the UV lamp 110 is adjusted the UV beam can be directed not only to the filter 370, but also to the inside of the tub.

The flow passage control valve 390 includes a rotation shaft 391 coupled to a shaft of a control motor 393, and a flow passage disk 392 having a plate shape on the whole at a top of the rotation shaft 391 having a communication hole **392*a* for opening/closing the main flow passage 341, and 342 as the flow passage disk 392 rotates. The flow passage control valve 390 can have the plate shape because the main flow passage 341, and 342 is arranged above the flow passage control valve 390. Since a pumping pressure of the washing pump 320 is applied to a top side of the flow passage control valve 390, if the pumping pressure is applied the upper housing 340 is compressed to secure the upper housing 340** without shaking.

In the meantime, it is preferable that inside surfaces of the sump 3, the main flow passage 341, and 342 and/or the flow passage 5 are coated with nano-silver Ag. Because it is liable that microbes breed in the sump 3, the main flow passage 341, and 342 and/or the flow passage 5 due to residual water, the breeding of the microbes can be prevented in advance by coating the nano-silver having antibacterial effect on the sump 3, the main flow passage 341, and 342 and/or the flow passage 5.

The fan (not shown) is operated for a predetermined time period during or after operation of the UV generator 110, for discharging air from the tub to an outside of the dish washer. The fan is mounted in the dish washer, preferable on the door.

The operation of the dish washer **1*d*** in accordance with a fourth preferred embodiment of the present invention will be described.

The dish washer 1*d* washes dishes while performing pre-washing, main washing, rinsing, and sterilizing courses in succession or selectively. Between the course, a draining course is performed. The main washing, rinsing, draining, and sterilizing courses will be described.

The washing course of the dish washer 1*d* will be described.

Upon putting the washing motor 321 into operation, to rotate the impeller 322, the washing water flows to the pump chamber 331 and the flow passage control chamber 332.

In this instance, the flow passage control valve 390 rotates to make the main flow passage 341 and 342 and the flow control chamber 332 in communication. The flow passage control valve 390 can open only one or both of the main flow passage 341 and 342. Moreover, the flow passage control valve 390 can open the main flow passage 341, and 342, alternately.

Once the main flow passage 341, and 342 are opened the washing water is provided from the flow passage control chamber 322 to the spray nozzle 8 through the flow passage 5 following the main flow passage 341, and 342.

Accordingly, since an amount of the washing water sprayed to the dishes increases, to use all the washing water pumped thus for only washing the dishes, a capacity of the washing pump 320 can be reduced and the amount of the washing water is also reduced, significantly.

The washing water sprayed from the spray nozzle 8 falls onto the cover 360 after washing the dishes. In this instance, since the cover 360 is sloped toward the filter 370, the washing water and contaminant fallen on the cover 360 is introduced into the upper filter 376. Moreover, a portion of the washing water is introduced into the sump 3 directly through the filter holes 361 in the cover 360.

Large sized contaminant is filtered at the upper filter 376, and contaminant not filtered at the upper filter 376 is filtered at the lower filter 371, to introduce only filtered washing water into the sump 3, at the end.

As such a washing course is performed for a predetermined time period, the dishes are washed while the washing water is filtered. In this instance, as time passes by, table waste collected at the filter 370 increases gradually. If the washing course is finished, the draining course is started.

Upon putting the drain pump 380 into operation, the washing water is introduced into the contaminant holding chamber 311 through the lower filter 371 by the drain pump 380, and introduced to the drain chamber 313 together with the contaminant collected at the contaminant holding chamber 311. In this instance, since the contaminant holding chamber 311 is sloped toward the drain chamber 313, the contaminant is introduced into the drain chamber 313 smoothly. Then, the contaminant and washing water is discharged to an outside of the dish washer through the drain hole in the drain chamber 313 and a drain hose.

After the drain course is finished a heated rinsing is started.

In the heated rinsing, water is heated to a preset temperature by the heater in the sump 3, and sprayed toward the dishes, for enhancing a rinsing capability and sterilizing microbes. It is preferable that the water is maintained at approx. 80° C.

In the heated rinsing course, the UV lamp 110 can be operated. In this case, a sterilizing effect of the high temperature washing water and a sterilizing effect of the UV beam can be obtainable, to improve the sterilizing capability, further.

After the heated rinsing, water is drained, and a sterilizing course is started. The sterilizing course can also be performed together with the pre-washing, main washing, and rinsing courses.

Since the UV lamp in the middle of the space of the side of the tub 2 between the upper spray nozzle 8*a* and the lower spray nozzle 8*b* directs a UV beam into the tub 2 uniformly and a clean state is maintained by the strong washing water from the upper spray nozzle 8*a* and the lower spray nozzle 8*b*, such that the UV beam is not interfered by the contaminant, a strong sterilizing capability can be provided.

Different from the UV LED, since the UV lamp generates heat during operation, the UV lamp not only has a sterilizing capability of the UV beam, but also sterilizing and drying capabilities of the heat. Accordingly, the UV lamp 110 under the filter 370 and on one side of the contaminant holding chamber 311 directs the beam toward the filter 370, to dry around the filter 370 and the contaminant holding chamber as well as sterilize the same.

In a case an intensity of the UV lamp 110 in the vicinity the filter is adjusted, the UV beam can be emitted, not only to the filter 370, but also to an inside of the tub 2, a composite action of the UV lamp 110 on one side of the tub 2 and the UV lamp under the filer 370 further improve the sterilizing capability.

Since the surface of the lower filter 376 is coated with photo-catalytic material, to receive the UV beam from the UV lamp 110 to cause a chemical reaction to make sterilizing again, the sterilizing effect at the lower filter 376 having fine sized contaminant held therein can become greater (see FIG. 14).

The fan (not shown) on the door side is operated for a predetermined time period during or finish of operation of the UV lamp 110 to discharge air from the dish washer. Accordingly, the fan discharges ozone generated by the operation of the UV lamp 110 and smell from the contaminant filtered at the filter 370 is discharged to an outside of the dish washer.

Or alternatively, after the operation of the UV lamp 110 is finished the fan may be operated for a predetermined time period to de-odor the ozone. In this instance, it is preferable that the fan is operated for 5 minutes.

FIG. 15 illustrates a front view of a dish washer in accordance with a fifth preferred embodiment of the present invention, and FIG. 16 illustrates a partial perspective view of an inside of a door of a dish washer 1*e* in accordance with the fifth preferred embodiment of the present invention.

A basic system of the dish washer in accordance with the fifth preferred embodiment of the present invention is the same with any one of the dish washers in accordance with the first to fourth preferred embodiments of the present invention. However, different from above embodiments, the embodiment has a predetermined size of window on the door 6, for enabling to determine a state of an inside of the tub 2.

In detail, the door 6 includes a door liner 6*a* and a door cover 6*b*. The door cover 6*b* forms an exterior thereof and the door liner 6*a* is mounted on an inside of the door cover 6*b*. There is a space between the door liner 6*a* and the door cover 6*b*, in which a condensing duct or a PCB is placed. In other word the condensing duct or the PCB is attached to a front side of the door liner 6*a*, and protected by the door cover 6*b*.

Moreover, on a rear side of the door liner 6*a*, i.e., on a portion of the door liner 6*a* facing the inside of the tub 2, there are a case 64 attached thereto for holding detergent or rinse, and a discharge hole (not shown) for discharging high temperature wet vapor generated in a high temperature washing course to an outside of the dish washer. There is a cover 65 having a plurality of holes formed therein mounted on the discharge hole.

Provided over the door liner 6*a*, there is an inner window 63 having predetermined width and length. The door cover 6*b* also has an outer window 63 at the same height with the inner window 63 having the same size with the inner window 63. It is preferable that the inner window 63 and the outer window 63 are formed of transparent material for looking an inside of the tub, and of heat resistant material for preventing the window from being deformed or broken by the high temperature wet vapor in the tub 2. It is preferable that the window 63 is formed on an upper side of the front of the door 6 for the user to look the inside of the tub 2 easily without bending oneself.

It is preferable that the window 63 is formed three dimensionally to have a volume, and the door liner 6*a* and the door cover 6*b* are formed to have fastening holes for fastening the window 63 thereto so that the window 63 is fastened together with the fastening holes in the door liner 6*a* and the door cover 6*b*.

According to above structure, the dishes in the tub 2 can be sterilized by the UV generator 110, and the user can determine an inside state of the tub 2 without opening the door 6 during washing or sterilizing, easily.

Moreover, the window 63 is formed three dimensionally to have a volume, and the door liner 6*a* and the door cover 6*b* are formed to have fastening holes for fastening the window 63 thereto so that the window 63 is fastened together with the fastening holes in the door liner 6*a* and the door cover 6*b*. In this case, a state is prevented in which the window 63 is wet with dew such that the user can not determine an inside state of the dish washer because the window 63 is washed with the washing water sprayed from the spray nozzle 8. Eventually, the user can determine the inside of the tub 2 more easily from an outside of the dish washer.

INDUSTRIAL APPLICABILITY

The industrial applicability of the present invention is described in the detailed description of the invention, thereby being omitted herein.

The invention claimed is:

1. A dish washer, comprising:

a tub that receives a plurality of dishes in an interior space thereof;

a sump that holds washing water;

at least one spray nozzle that sprays the washing water into the interior space; and at least one ultraviolet (UV) generator that directs a UV beam into the interior space, wherein the at least one UV generator is mounted at a corresponding side wall of the tub, and wherein the at least one UV generator includes:

a housing mounted at a pass through hole formed in the corresponding side wall of the tub, wherein the housing holds a UV lamp or a UV light emitting diode (LED); and a bracket mounted on an exterior side of the corresponding side wall of the tub opposite the housing and connected to the housing so as to mount the housing in the pass through hole, wherein the housing includes a seating portion that is seated on an inner circumferential surface of the pass through hole, and the bracket includes a compression portion that presses the seating portion into the pass through hole when the bracket is fastened to the housing, and wherein the compression portion of the bracket is elastically deformable and is supported on the exterior side of the corresponding side wall of the tub to elastically support the housing in the pass through hole.

2. The dish washer as claimed in claim 1, further comprising at least one rack provided in the interior space of the tub for holding the plurality of dishes, and wherein a mounting position of the at least one of the at least one UV generator corresponds to a position of the at least one rack in the interior space of the tub.

3. The dish washer as claimed in claim 1, further comprising a door coupled to a front of the tub that opens and closes the tub, wherein the door includes electric components mounted therein, and wherein the tub includes a flow passage mounted on a rear side thereof that provides the washing water to the at least one spray nozzle, and wherein the at least one UV generator is provided on a lateral side of the tub that extends between the front and rear end thereof.

4. The dish washer as claimed in claim 3, wherein the at least one spray nozzle includes an upper spray nozzle that sprays the washing water downward from an upper portion of the tub into the interior space of the tub, and a lower spray nozzle that sprays the washing water upward from a lower portion of the tub into the interior space of the tub, and wherein the at least one UV generator is provided at a middle of a space between the upper spray nozzle and the lower spray nozzle.

5. The dish washer as claimed in claim 1, wherein the at least one UV generator further includes a sealing member that forms a seal between the seating portion of the housing and the circumferential surface of the pass through hole.

6. The dish washer as claimed in claim 1, wherein the housing includes at least one rib formed on an outside surface thereof that contacts an edge of the circumferential surface of the pass through hole so that the housing is press fit in the pass through hole.

7. The dish washer as claimed in claim 6, wherein the at least one rib has a sloped surface so as to be fitted into the pass through hole.

8. The dish washer as claimed in claim 6, wherein the at least one rib is formed of a material having a hardness lower than a hardness of the tub.

9. The dish washer as claimed in claim 1, further comprising at least one recess formed in the compression portion of the bracket, wherein the at least one recess contacts the circumferential surface of the pass through hole.

10. The dish washer as claimed in claim 1, further comprising a filter that filters the washing water, wherein the at least one UV generator is arranged to direct a UV beam toward the interior space of the tub and the filter at the same time.

11. The dish washer as claimed in claim 1, further comprising a filter that filters the washing water, wherein the at least one UV generator is arranged close to the filter.

12. The dish washer as claimed in claim 11, wherein the at least one UV generator is positioned below the filter.

13. The dish washer as claimed in claim 12, wherein the at least one UV generator is tilted.

14. The dish washer as claimed in claim 11, wherein the filter is coated with a photocatalytic material.

15. The dish washer as claimed in claim 1, further comprising a fan that discharges air to an outside of the dish washer during operation or after completion of the operation of the at least one UV generator.

* * * * *